United States Patent [19]

Hollweck

[11] 4,053,859

[45] Oct. 11, 1977

[54] TEMPERATURE SENSITIVE SWITCH

[75] Inventor: Walter Hollweck, Nurnberg, Germany

[73] Assignee: INTER CONTROL, Herman Kohler Elektrik GmbH & Co KG, Nurnberg, Germany

[21] Appl. No.: 727,519

[22] Filed: Sept. 28, 1976

[30] Foreign Application Priority Data

Oct. 3, 1975 Germany ..... 2544201

[51] Int. Cl.[2] ..... H01H 61/00

[52] U.S. Cl. ..... 337/91; 337/348

[58] Field of Search ..... 337/56, 91, 343, 348, 337/365, 367

[56] References Cited

U.S. PATENT DOCUMENTS

| | | | |
|---|---|---|---|
| 2,714,644 | 8/1955 | Harrison | 337/348 |
| 3,379,843 | 4/1968 | Shaffer et al. | 337/56 |

FOREIGN PATENT DOCUMENTS

| | | | |
|---|---|---|---|
| 1,523,416 | 9/1966 | Germany | 337/367 |

*Primary Examiner*—George Harris
*Attorney, Agent, or Firm*—Spencer & Kaye

[57] ABSTRACT

A temperature sensitive switch has openable and closable electric contacts, a two-position bimetallic element and a two-position bistable element, both coupled to the contacts. At a predetermined maximum temperature, the bimetallic element moves from a first position to a second position and thereby opens the contacts and also moves the bistable element from a first position into a second position. The bistable element, in its second position, maintains the contacts open independently from the position of the bimetallic element, until the bistable element is reset from its second position to its first position, and thus the contacts are closed, by an external (manual) resetting force.

10 Claims, 3 Drawing Figures

TEMPERATURE SENSITIVE SWITCH

BACKGROUND OF THE INVENTION

This invention relates to a temperature sensitive switch and is particularly applicable to thermal circuit breakers, i.e. switches which open a circuit when a temperature reaches a predetermined danger level and need to be reset in order to close the circuit again.

Switches of this type are known which utilize a snapaction convex bimetallic disc which reverses its direction of convexity when the temperature rises above a particular value and, in doing so, operate the contacts of the switch. In switches of this type it is possible for the bimetallic disc to return in its initial condition if it is allowed to cool to a very low temperature, e.g. −25° C. This re-closes the contacts. Such re-closing of the contacts contravenes safety regulations which require that after the contacts have been open circuited, they should only be closed again by manual intervention. In order to avoid this problem, another switch has been proposed which includes a mechanical ratchet device which ensures that when the bimetallic disc returns to its initial condition under the influence of a cold temperature, such motion is not transmitted to the contacts. This arrangement is effective but very expensive because of its complexity.

SUMMARY OF THE INVENTION

It is an object of the invention to provide an improved thermal circuit breaker which meets the aforementioned safety regulations, which is of relatively simple structure and therefore is inexpensive to manufacture.

This object and others to become apparent as the specification progresses, are accomplished by the invention, according to which, briefly stated, the temperature sensitive switch has openable and closable electric contacts, a two-position bimetallic element and a two-position bistable element, both coupled to the contacts. At a predetermined maximum temperature, the bimetallic element moves from a first position to a second position and thereby opens the contacts and also moves the bistable element from a first position into a second position. The bistable element, in its second position, maintains the contacts open independently from the position of the bimetallic element, until the bistable element is reset from its second position to its first position, and thus the contacts are closed, by an external (manual) resetting force.

The position of the contacts is thus dependent on the condition of the bistable element (plate or disc) and so, by suitable design, the bimetallic element can be allowed to return to its initial condition without the movable of contacts returning to their initial, closed condition. This can be done simply by arranging the temperature sensitive element so that when there is a temperature rise it presses against one side of the bistable plate and changes its state; and when the temperature subs equently drops, it moves away from the bistable plate so that the latter remains in its changed state. Some manually operable resetting device is preferably included.

The convex bistable plate is preferably designed in such a way that the force which the bimetallic element has to apply on it in order to change its state is smaller than the force which needs to be applied manually in the opposite direction to reset the switch. This is to minimize the effect of the bistable plate on the switching temperature.

DESCRIPTION OF THE PREFERRED EMBODIMENT

Figure 1:
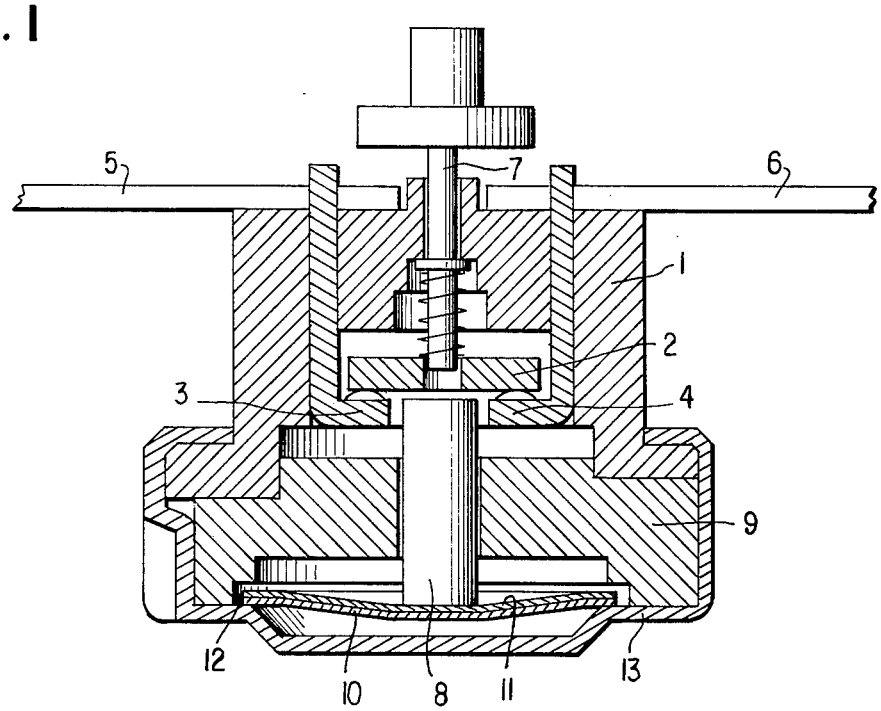
FIG. 1 shows a cross-section through the temperature sensitive switch according to the invention, with the contacts closed.

In FIG. 1 reference numeral 1 denotes a housing in which a spring-loaded displaceable contact bridge (movable contact) 2, fixed contacts 3 and 4, electrical connections 5 and 6 and a resetting pin 7 are disposed. A transmission pin 8 is mounted for displacement in a guide disc 9 and transmits movement of the center of a snap action, disc-shaped bimetallic plate 10 to the contact bridge 2. Freely movably mounted between the bimetallic plate 10 and the transmission pin 8 is a convex, disc-shaped metal plate 11 which is of substantially the same diameter as the disc 10. This disc 11 also performs a snap action between two stable conditions in which its convexity is respectively reversed; thus, it will be referred to as a bistable element. Both discs 10 and 11 are disposed in a recess 12 between the guide disc 9 and a bulging closure member 13.

When the temperature rises above a preset limit, the bimetallic disc 10 snaps from the position of FIG. 1 to a position in which its curvature is reversed. In doing so, it presses against one side of the bistable plate 11 which also reverses its curvature in a snap action.

Figure 2:
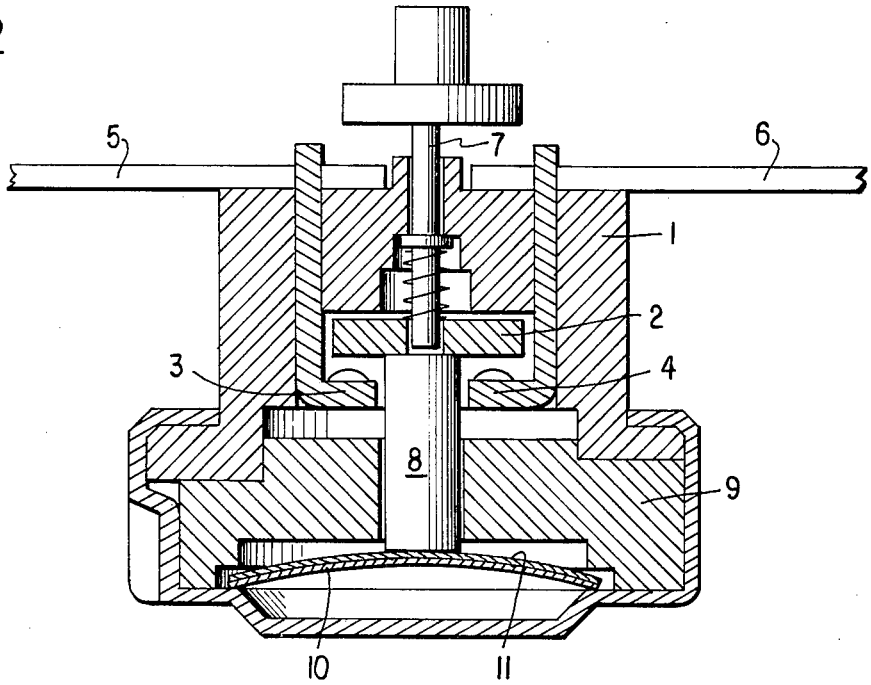
FIG. 2 shows the temperature sensitive switch after switching off.

FIG. 2 shows the temperature sensitive switch after the bimetallic disc 10 and the bistable element 11 have snapped over whereby, by means of the transmission pin 8, the contact bridge 2 is moved upwardly and is no longer in engagement with the fixed contacts 3, 4.

Figure 3:
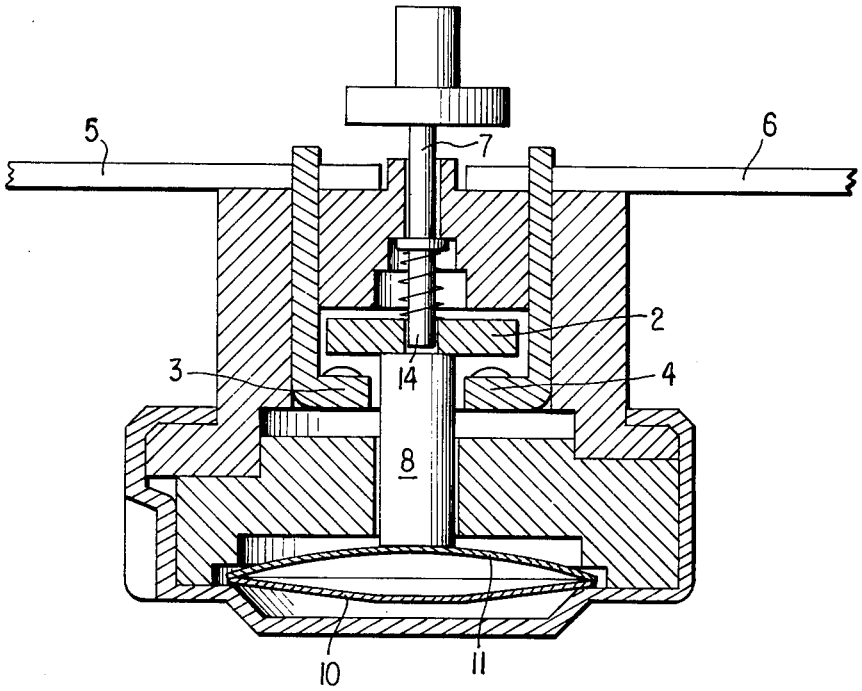
FIG. 3 shows the temperature sensitive switch after the bimetallic disc-shaped plate has sprung back.

FIG. 3 shows how, after the bimetallic disc 10 has snapped back into its starting position, the bistable element 11 remains in the Off position, and thus continues to hold the contact bridge 2 in an open position upwards by the intermediary of the transmission pin 8. This view clearly shows that the bistable element 11 can only be pushed back by means of the resetting pin 7 which protrudes into a recess 14 in the contact bridge 2.

The bistable disc 11 is so designed that less force is required to snap it to its closed position (FIG. 2) than to its open position (FIG. 1). This is because the height of convexity in the condition of FIG. 1 is less than in FIG. 2 as can clearly be seen by a comparison of the two drawings.

It will be understood that the above description of the present invention is susceptible to various modifications, changes and adaptations, and the same are intended to be comprehended within the meaning and range of equivalents of the appended claims.

What I claim is:

1. In a temperature sensitive switch including a movably supported electric contact having a closed and an open position, a temperature sensitive element coupled to the movable contact and being arranged for displacement from a first position to a second position at a predetermined maximum temperature; the temperature sensitive element being further arranged to move the movable contact from the closed position into the open position upon motion of the temperature sensitive element from the first position into the second position; the improvement comprising a. a bistable element having first and second positions and being coupled to said temperature sensitive element and said movable contact; said bistable element being arranged for movement from is first position into its second position by said temperature sensitive element when said temperature sensitive element moves from its first position into its second position; said bistable element being arranged for maintaining, in its second position, said movable contact in said open position independently from the position of said temperature sensitive element; and b. resetting means for simultaneously moving said bistable element from its second position into its first position and said movable contact from said open position to said closed position independently from the position of said temperature sensitive element.

2. A temperature sensitive switch as defined in claim 1, wherein said temperature sensitive element and said bistable element are supported in an adjoining relationship.

3. A temperature sensitive switch as defined in claim 1, wherein said resetting means includes a resetting pin.

4. A temperature sensitive switch as defined in claim 1, wherein said temperature sensitive element is a bimetallic member.

5. A temperature sensitive switch as defined in claim 4, wherein said bimetallic member is disc-shaped.

6. A temperature sensitive switch as defined in claim 1, further comprising a slidably supported transmission pin having one end cooperating with said movable contact and another end cooperating with said temperature sensitive element and said bistable element.

7. A temperature sensitive switch as defined in claim 6, further comprising a switch housing defining a recess; and temperature sensitive element and said bistable element are shaped as discs arranged in a face-to-face relationship in said recess; each disc assuming a first convexity oriented in a direction away from said transmission pin and corresponding to the first position of both elements and a second convexity oriented in a direction towards said transmission pin and corresponding to the second position of both elements; said temperature sensitive element, when moving from its first convexity to its second convexity at said predetermined maximum temperature, displaces said bistable element from its first convexity to its second convexity and displaces said movable contact from its closed position into its open position with the intermediary of said bistable element and said transmission pin.

8. A temperature sensitive switch as defined in claim 1, wherein said bistable element is plate-shaped and is more resistant to a force tending to move it from its second position to its first position than to a force tending to move it from its first position to its second position.

9. A temperature sensitive switch as defined in claim 8, wherein said bistable element has a configuration in its first position different from a configuration in its second position.

10. A temperature sensitive switch as defined in claim 9, wherein said bistable element has oppositely oriented convexities in the first and second positions, the convexity of said bistable element has a greater height in said second position than in said first position.

* * * * *